US007994731B2

(12) United States Patent
Biggs

(10) Patent No.: US 7,994,731 B2
(45) Date of Patent: Aug. 9, 2011

(54) UNIVERSAL INPUT VOLTAGE DEVICE

(75) Inventor: Nathan E. Biggs, Wichita, KS (US)

(73) Assignee: PWI, Inc., Wichita, KS (US)

( * ) Notice: Subject to any disclaimer, the term of this patent is extended or adjusted under 35 U.S.C. 154(b) by 205 days.

(21) Appl. No.: 12/342,365

(22) Filed: Dec. 23, 2008

(65) Prior Publication Data

US 2009/0134818 A1 May 28, 2009

Related U.S. Application Data

(63) Continuation of application No. 11/874,705, filed on Oct. 18, 2007, now Pat. No. 7,486,030.

(51) Int. Cl.
*H05B 41/16* (2006.01)

(52) U.S. Cl. ..... 315/247; 315/225; 315/287; 315/291; 363/124; 363/143; 363/21.01; 363/41

(58) Field of Classification Search ..... 315/219, 315/224, 225, 247, 279, 287, 291, 209 R, 315/307, DIG. 5; 363/21.01, 21.06, 21.09, 363/21.1, 21.12, 124, 143, 41
See application file for complete search history.

(56) References Cited

U.S. PATENT DOCUMENTS

| | | | | |
|---|---|---|---|---|
| 4,073,003 | A * | 2/1978 | Chambers | 363/20 |
| 5,130,611 | A * | 7/1992 | Johns | 315/224 |
| 5,359,274 | A * | 10/1994 | Bandel | 323/207 |
| 5,363,020 | A * | 11/1994 | Chen et al. | 315/209 R |
| 5,973,948 | A | 10/1999 | Hahn et al. | |
| 6,137,240 | A | 10/2000 | Bogdan | |
| 6,137,697 | A | 10/2000 | Tarodo et al. | |
| 6,343,021 | B1 | 1/2002 | Williamson | |
| 6,424,546 | B2 | 7/2002 | Rivas Saiz et al. | |
| 6,538,909 | B2 | 3/2003 | Goodarzi et al. | |
| 6,664,758 | B2 | 12/2003 | Yang | |
| 6,970,364 | B2 | 11/2005 | Batarseh et al. | |
| 7,050,311 | B2 | 5/2006 | Lai et al. | |
| 7,119,494 | B2 * | 10/2006 | Hui et al. | 315/219 |
| 7,221,107 | B2 * | 5/2007 | Melis | 315/291 |

* cited by examiner

*Primary Examiner* — Haissa Philogene
(74) *Attorney, Agent, or Firm* — Erickson, Kernell, Derusseau & Kleypas, LLC

(57) ABSTRACT

A universal input voltage device is presented which may receive a wide range of regulated and unregulated input voltages, both DC and a wide range of variable frequency AC, and output a desired regulated current at a desired voltage independent of the fluctuation of input voltage and frequency. The circuit includes a preconditioning input circuit, a Buck converter circuit with over voltage protection, flyback and boost circuits, and a shutdown circuit configured to drive a predetermined electrical or electronic device.

19 Claims, 5 Drawing Sheets

UNIVERSAL INPUT VOLTAGE DEVICE

CROSS REFERENCE TO RELATED APPLICATION

This application is a continuation of application Ser. No. 11/874,705, filed Oct. 18, 2007 now U.S. Pat. No. 7,486,030, entitled UNIVERSAL INPUT VOLTAGE DEVICE.

FIELD OF THE INVENTION

The present invention relates to a power supply and, more particularly, a power supply adapted to receive a wide range of regulated and unregulated input voltages, both DC and a wide range of variable frequency AC, independent of fluctuation in voltage and frequency, and output a desired current/voltage to drive any electrical device such as a gas discharge lamp or LED lighting device.

BACKGROUND OF THE INVENTION

Conventionally, input power requirements for gas discharge lamp lighting devices, such as hot cathode and cold cathode lamps, have been restricted to a specific power source. These gas discharge lighting systems are dependent on power sources of 110 volts or 220 volts AC at frequencies of 50 or 60 Hz, or DC voltages of 12 volts or 24 volts, for example and the same can be said for an LED lighting device. While these power sources are readily available in urban locations most of the time, at times of adverse weather, the consistency of commercial power sources may be compromised. In rural areas, the quality and consistency of local power sources may be variable, independent of adverse weather. Additionally, in adverse environments such as automotive, avionic and military applications, the quality and consistency of the output from electrical and power generation equipment may be unusable as an input power source for electrical and electronic devices in general, and specifically gas discharge lamp lighting devices.

Additionally, wind-driven generators and solar cells are not optimized for efficiency because the output from these generators is regulated to provide a usable output power. Regulation is accomplished by governing the rotational speed and thus frequency of the generator, or by using the DC output of a solar cell indirectly through an inverter or to charge a battery.

SUMMARY OF THE INVENTION

The present invention provides a circuit for driving electrical and electronic devices such as gas discharge lighting devices and LED lighting devices from unregulated input power source ranging from less than 12 volts to 180 volts or more, AC or DC, pulsed DC or halfwave, fullwave rectified and variable frequency AC. The circuit generally includes a Buck converter coupled to a synchronous rectifier/crowbar circuit coupled to a single-ended inverter to provide a high voltage to start discharge and a lower sustaining voltage after start up required by gas discharge lighting devices not restricted to a particular input power source. This circuit automatically adjusts varying input voltages to the necessary output voltage to start and sustain a gas discharge lighting device.

The present invention eliminates the conventional steady state voltage requirements of the load i.e. lighting system and allows the electric generation source to operate in a dynamic or static state to achieve optimal power source efficiency.

Source inputs may be unregulated electrical power from any centralized, locally distributed or storage source including unloaded permanent magnet generators and alternators. If an unregulated electrical power source is local to where the electricity is used, local transmission of the unregulated electrical power may minimize the resistive line losses during transmission eliminating the conventional conversion processes and the associated loss before transmission.

The present invention is well suited for lighting applications that may receive power from a diversified range of energy sources. The present invention is not limited by packaging and may drive linear lengths of lamps as in standard neon tubes, cold cathode fluorescent lamps, compact fluorescent lamp, as well as LED lighting systems. The present invention is also well suited as a universal lighting system driver with applications ranging from transportation systems, to fixed grid tied lighting. And the new applications that will lend themselves to a nonspecific power source lighting system.

The present invention may be used to drive a discharge lamp lighting device in which the lamp requires a high voltage to start discharge and a lower sustaining voltage after start up. A current feedback loop for lamp regulation and a lamp open detection circuit may also be included.

DETAILED DESCRIPTION

Figure 1:
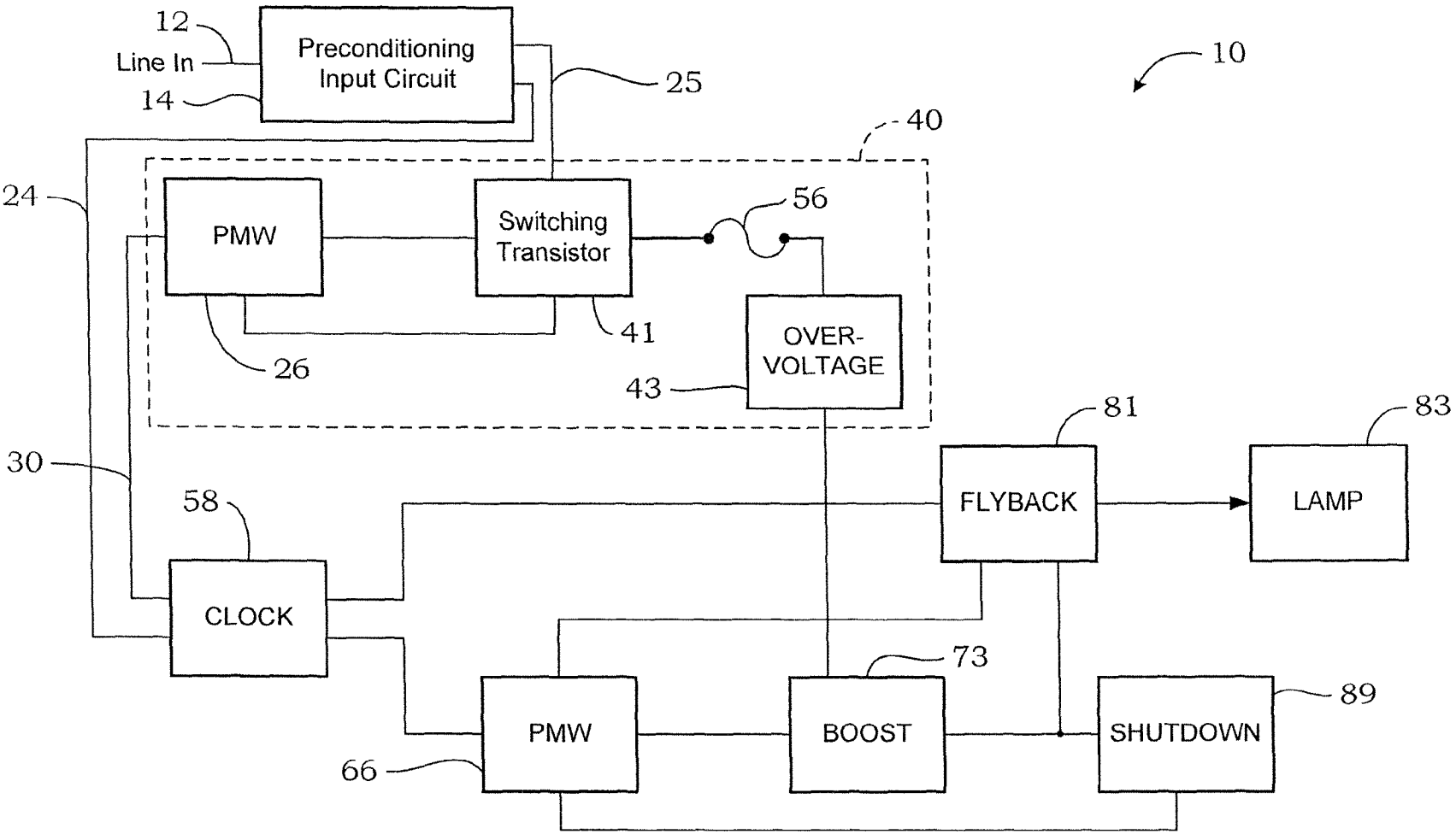
FIG. 1 is a functional block diagram of the circuit of the present invention.

Referring initially to FIG. 1, a functional block circuit diagram of a universal output voltage device is generally indicated by reference numeral 10. Circuit 10 includes an input 12 to a preconditioning input circuit 14. An output on line 24 provides initial power to start clock 58 which provides a reference voltage to pulse wave modulator 26. At the same time, an output on line 25 provides initial power to a switching transistor 41 of Buck converter circuit 40. An over-voltage circuit 43 in combination with a fuse 56 protects the circuit 10 from over-voltage conditions that may damage the system. An output from the Buck converter circuit 40 powers a boost circuit 73 initially bypassing the shutdown circuit 89 to allow the flyback circuit 81 to provide the power necessary for the initial ionization of the lamp 83. Once the circuit is running, the shutdown circuit 89 monitors the output of the flyback circuit 81 for an overvoltage condition providing feedback to the comparator 66.

Figure 2A:
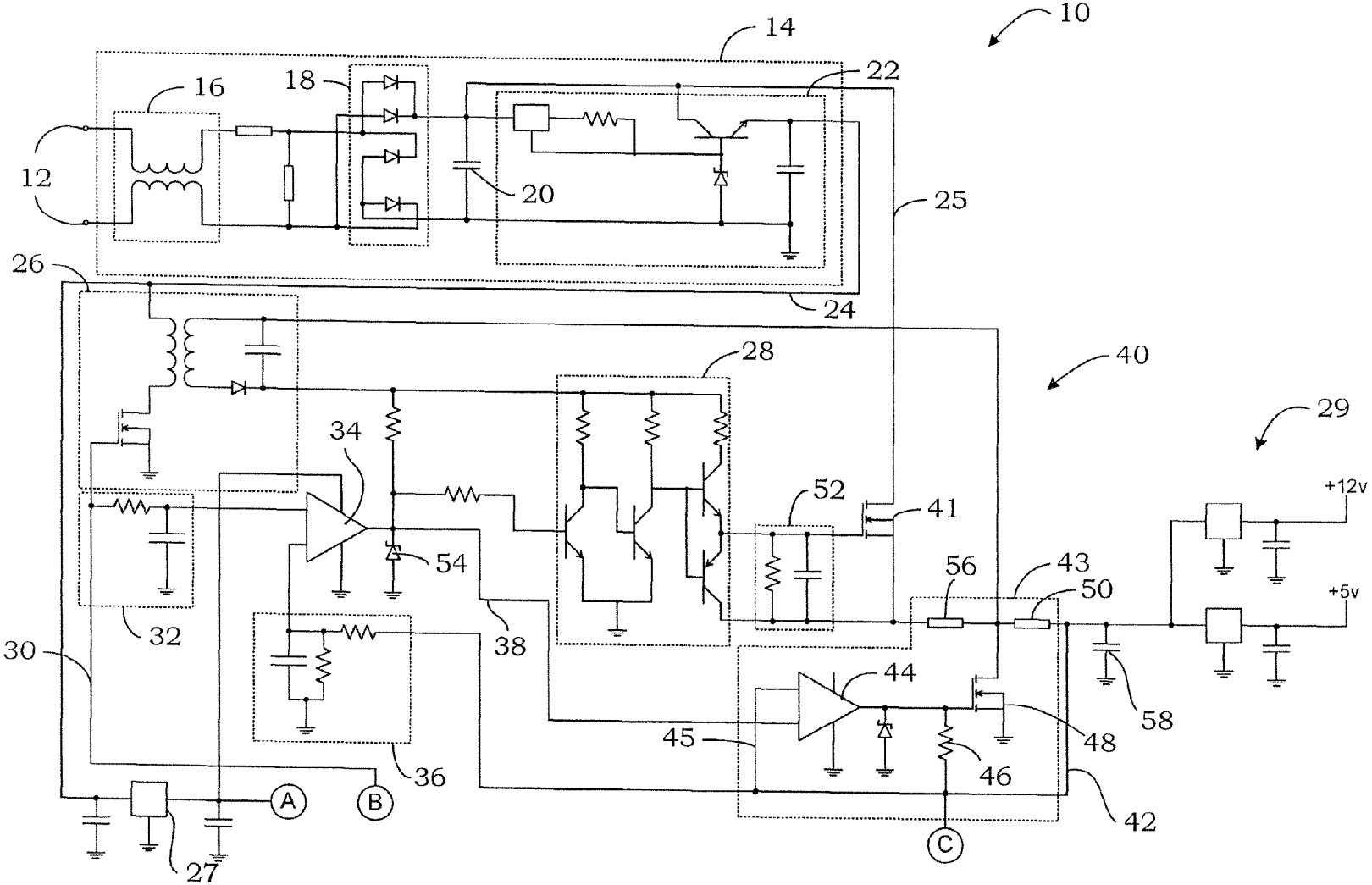
FIG. 2A is a partial view of a detailed schematic of the circuit of the present invention.
Figure 2B:
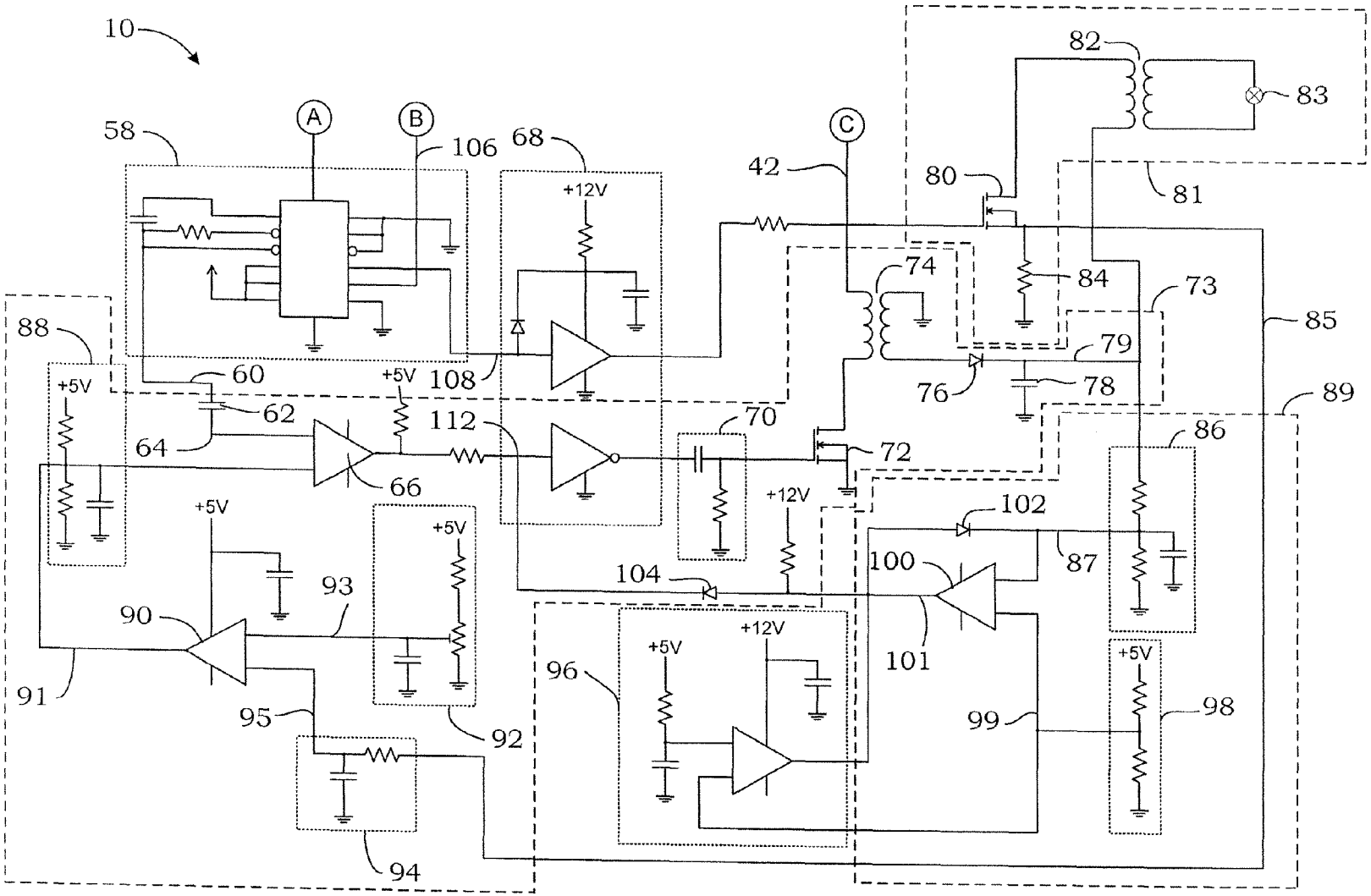
FIG. 2B is a continuation of the detailed schematic of FIG. 2A.

Referring to FIGS. 2A and 2B, the universal input voltage device is shown in more detail. Universal input voltage device 10 includes input 12 coupled to preconditioning input circuit 14. Preconditioning input circuit 14 includes a noise filter inductor 16 coupled to a rectifier 18, filter 20 and prelinear voltage regulator 22. Preconditioning input circuit 14 provides the initial input conditioning and drive circuit for the universal input voltage device 10.

Preconditioning input circuit 14 is coupled via line 24 a 5-volt power supply 27 for clock 58 and to a single-ended switch mode isolated circuit 26 for high side gate driver circuit 28 of Buck converter 40. The preconditioning input circuit 14 is also coupled to a Buck converter circuit 40 on line 25 to drive a switching transistor 41. Line 25 can be unfiltered with filter 20 removed and the ripple at line 25 can be 100 percent. Buck converter circuit 40 may achieve up to a 100% duty cycle and significantly improves the performance of the circuit when the input supply at 12 is lower than the desired voltage output of the Buck converter on line 42. The output on line 42 drives 5 and 12-volt power supplies 29, which provide power to the rest of the circuit, as well as the boost circuit 73.

Figure 3:
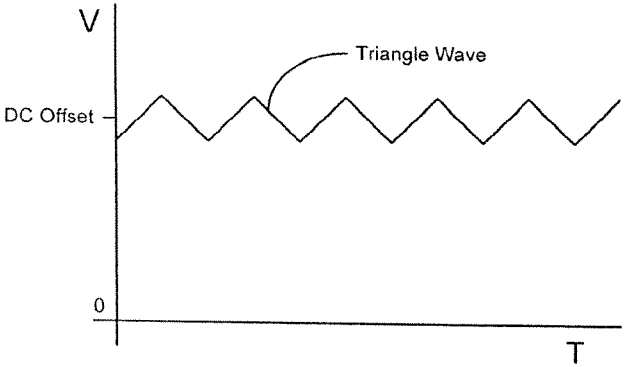
FIG. 3 is a DC offset triangular waveform.

To achieve a 100% duty cycle, a DC offset triangle waveform (FIG. 3) is generated by integrating the output clock cycles on line 30 from the QNot output 106 of the astable multi-vibrator 58 through integrator circuit 32 and comparator 34. The comparator 34 compares the reference output feedback or compensation pole 36 generated from a voltage feedback from output 42 of Buck converter 40 to the DC offset triangle waveform output of integrator circuit 32 and generates a pulse width output on line 38 referenced to the triangle waveform (FIG. 3) during normal regulations. A DC offset below the triangle waveform generates a 100% pulse width when the input supply at 12 is lower than the desired output at 42. Additional performance improvements are achieved with this circuit when the input supply is a battery. In addition to compensation pole 36 a second compensation pole 52 is included to stabilize operation of the circuit and provide a relatively high immunity to noise on input 12.

Figure 4:
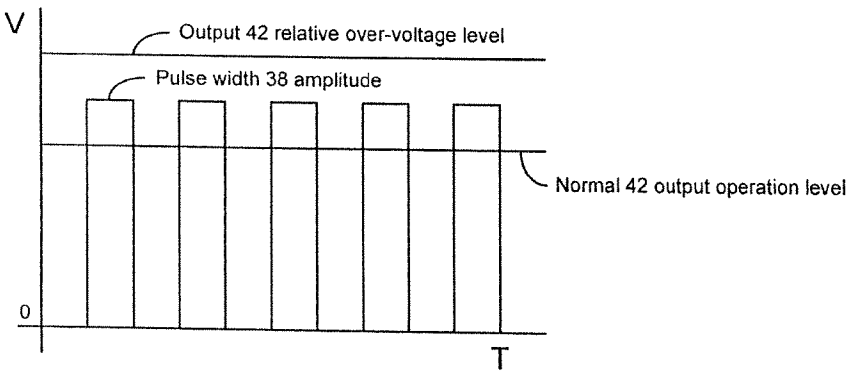
FIG. 4 is a pulse width waveform showing DC level for normal operation and for an over-voltage condition.

The circuit 10 includes a high voltage protection circuit in the event of component failures resulting in a voltage higher than the desired voltage at output 42 using a combination synchronous rectifier/crowbar combination 43. The DC output 42 during normal operation is the reference voltage input to comparator 44 on line 45 which is compared to a pulse on line 38. The pulse width amplitude 38 is set higher by clamp zener diode 54 than the reference provided by output 42 during normal operation (See FIG. 4). Comparator 44 drives synchronous switching transistor 48 closed when the main switching transistor 41 is closed and vice versa to prevent cross conduction of the synchronous switching transistor 48 and the main switching transistor 41 during normal operations. Turn on dead time for the synchronous switch is provided by the DC time consisting of resistor 46 and the gate capacitance of synchronous switching transistor 48 relative to the fast turn on time constant of high side gate driver 28 and the main switching transistor 41. The turn on dead on time for the main switching transistor 41 is provided by the relative slow turn on time constant of high side gate driver 28 to the fast turn off of the synchronous switching transistor 48 by the direct connection to the open collector of comparator 44.

During normal operation, comparator 44 and synchronous switching transistor 48 act as a synchronous rectifier as well as an output 42 over voltage sensor and a crowbar circuit 43. When the output at 42 is greater than the desired output voltage referenced to the pulse width amplitude on line 38 set by the clamp zener 54, comparator 44 detects a fault condition and turns on the synchronous switching transistor 48. The main switching transistor 41 and synchronous switching transistor 48 are on simultaneously effectively grounding the source and open fuse link 56 which disconnects output 42. Open fuse link 56 also isolates the single ended switch mode source 26 from over voltage protecting the high side gate driver 28 and associated controller circuitry.

Figure 5:
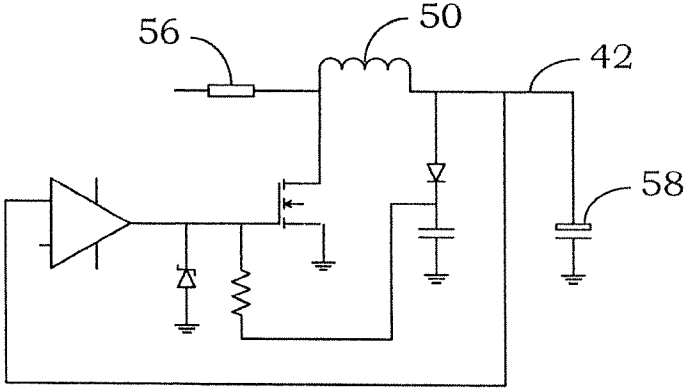
FIG. 5 is an alternative circuit with optional diode and capacitor.

The resistor 46 is sourced from the output 42 and aids in the power up sequence and provides drive to the synchronous switching transistor 48 and open fuse link 56. If more driving time is needed, an optional diode and capacitor 110 (FIG. 5) may be added to isolate the resistor 46 from the discharge rate of the output 52 and filter capacitor 58 to give the fuse link 56 additional time to blow when necessary.

Figure 6A:
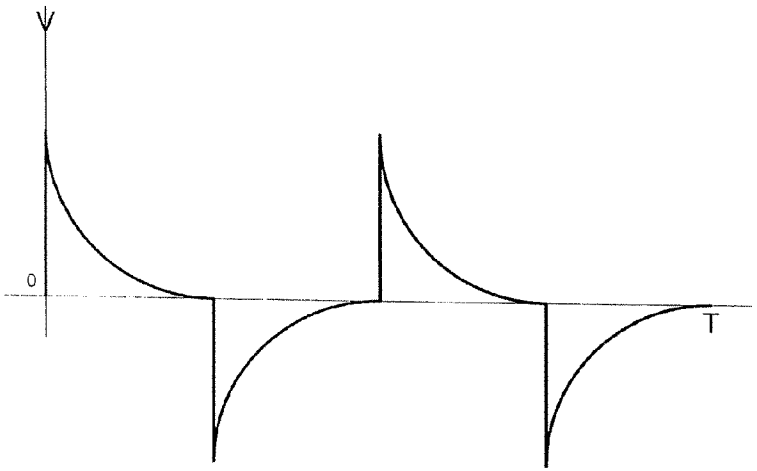
FIG. 6A is a waveform output from an astable multivibrator.
Figure 6B:
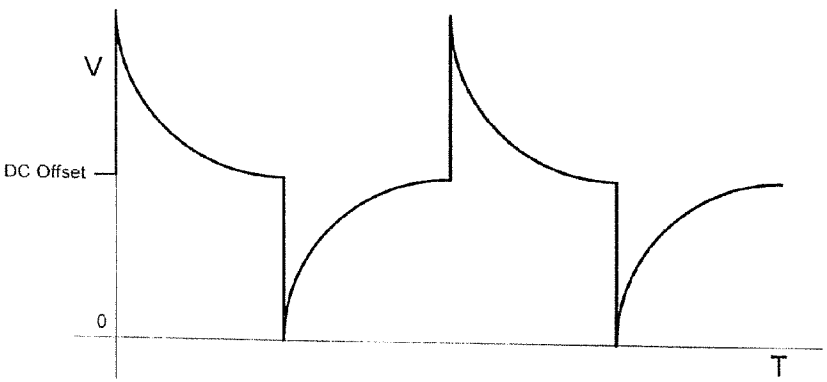
FIG. 6B is the waveform of FIG. 6A with a DC offset.

The next stage includes clock 58 such as a CMOS 4047. The DC common pin output on line 60 is a waveform (FIG. 6A) which is coupled to capacitor 62 to provide a DC offset waveform on line 64 (FIG. 6B) and ramp for CMOS comparator pulse width modulator 66. Comparator pulse width modulator 66 is current buffered by a high current gate driver 68. The high current gate driver 68 is capacitively coupled and ground referenced 70 to switching transistor 72. Capacitor coupled and ground reference 70 ensures that the switching transistor 72 remains in an off state as a fault protection in the event of a drive circuitry failure.

Figure 7:
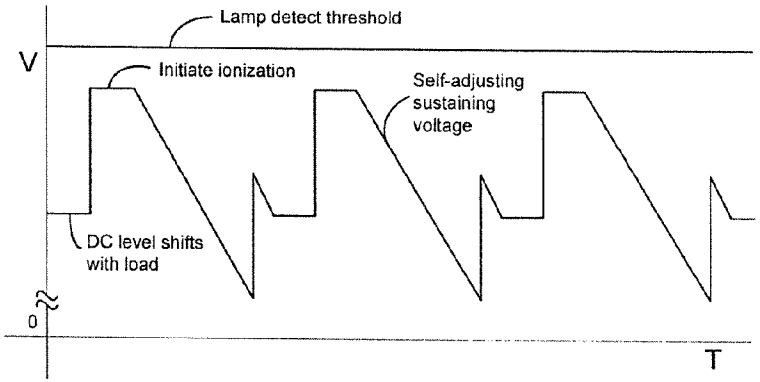
FIG. 7 is a waveform showing initial ionization, sustaining voltage, and open lamp detect levels.

A primary transformer 74 is connected to and sourced from output 42. Primary transformer 74 is also coupled to switching transistor 72 in a ground-applied configuration. Primary transformer 74 is configured in a flyback topology and its output is rectified by diode 76. Diode 76 is connected to capacitor 78 that has a value chosen to lightly filter the output on line 79 (See FIG. 7). The output on line 79 provides a relatively high voltage to the primary coil of current/voltage transformer 82 to initiate ionization of a discharge lamp 83 and to self adjust to a relative lower sustaining voltage after lamp excitation (See FIG. 7), which increases efficiency. The DC level of the output waveform shifts with the lamp load which provides a way to monitor relative lamp output voltage due to lamp aging and open lamp circuit condition.

The output on line 79 is also connected to a voltage divider filter network 86 which provides a DC level relative to the lamp voltage on line 87. A comparator 100 compares the relative lamp voltage from the voltage divider filter network 86 to a reference voltage 98 on line 99. If the relative lamp voltage is higher than desired, indicating aging lamps or a lamp open circuit condition (i.e., the lamp has burned out), comparator 100 output 101 goes high. Output 101 is coupled to diode 102 which is in turn coupled to the non-inverting input of comparator 100 thus forming a latched condition.

The output 101 of comparator 100 is also coupled to a diode 104 which is coupled to the high current gate driver 68 inverting stage input at 112. An output on line 101 effectively shuts down the lamp output upon a fault detection. A start up time delay circuit 96 disables output 101 of comparator 100 for a fixed amount of time to allow ionization of gas discharge lamp during normal operation and provide proper power up sequence to avoid inadvertent activation of the fault condition circuitry.

A sense resistor 84 senses the primary current of current/voltage transformers 82. The sensed signal value is proportionally related to lamp current. Sense resistor 84 is connected on line 85 to a filter pole 94. The output 95 of filter pole 94 is related to the output lamp current and is compared by comparator 90 to the current adjust voltage 92 on line 93. Current adjust voltage 92 may be replaced by an externally supplied voltage from an external lamp dimming controller. Comparator 90 output 91 is connected to a filter network 88 and a comparator 66 on line 89. Comparator 66 is a pulse width modulator. Connection to comparator 66 completes the current feedback loop and control of the gas discharge lamp current discussed above.

Initially, when power is applied to the circuit 10, the power is conditioned by preconditioning input circuit 14. The output on line 24 starts clock 58 which drives the single ended switch mode source 26 on line 30 to start the Buck converter circuit 40. The output of the Buck converter circuit 40 on line 42 drives the power supplies to the rest of the circuit and activates the boost circuit 73. The lamp 83 or other electric device is driven by the circuit.

The invention claimed is:

1. A constant output power circuit comprising:

a preconditioning input circuit for receiving an unregulated input power and converting said unregulated input power to a regulated DC output and an unregulated output;

a clock responsive to said regulated DC output from said preconditioning input circuit having an output, a Buck converter circuit for receiving said unregulated output from said preconditioning input circuit and responsive to said output from said clock to produce a regulated DC output at a predetermined voltage level, and a boost circuit for receiving said regulated DC output from said Buck converter circuit and providing an initial output voltage.

2. The circuit as set forth in claim 1 wherein said preconditioning input circuit includes a noise filter inductor coupled to a rectifier coupled to a filter coupled to a prelinear voltage regulator.

3. The circuit as set forth in claim 1 wherein said clock includes an astable multivibrator.

4. The circuit as set forth in claim 1 wherein said Buck converter includes a single-ended switch mode isolated circuit coupled to a high said gate driver circuit, a switching transistor having a source, a gate and a drain, said source coupled to said regulated DC output of said preconditioning input circuit, said gate coupled to said high side gate driver circuit, and said drain coupled to said regulated DC output of said Buck converter circuit.

5. The circuit as set forth in claim 1 further comprising a fuse and crowbar circuit coupled to said regulated DC output of said Buck converter circuit whereby said crowbar circuit causes said line fuse to blow in response to an overvoltage condition.

6. The circuit as set forth in claim 1 wherein said unregulated output is filtered.

7. The circuit as set forth in claim 1 wherein said unregulated output contains up to 100 percent ripple.

8. A constant output power circuit comprising:

a preconditioning input circuit for receiving an unregulated input power and converting said unregulated input power to a regulated DC output and an unregulated output, a clock responsive to said regulated DC output from said preconditioning input circuit having a first output and a second output, a Buck converter circuit for receiving said unregulated output from said preconditioning input circuit and responsive to said first output from said clock to produce a regulated DC output at a predetermined voltage, a primary transformer for receiving said regulated DC output from said Buck converter circuit having a flyback topology to produce an output voltage, a current/voltage transformer having an input coupled to said output voltage of said primary transformer and an output coupled to an electrical device, and a shutdown circuit coupled to said output of said primary transformer for determining an overvoltage condition.

9. The circuit as set forth in claim 8 wherein said preconditioning input circuit includes a noise filter inductor coupled to a rectifier coupled to a filter coupled to a prelinear voltage regulator.

10. The circuit as set forth in claim 8 wherein said clock includes an astable multivibrator.

11. The circuit as set forth in claim 8 wherein said Buck converter includes a single-ended switch mode isolated circuit coupled to a high said gate driver circuit, a switching transistor having a source, a gate and a drain, said source coupled to said regulated DC output of said preconditioning input circuit, said gate coupled to said high side gate driver circuit, and said drain coupled to said regulated DC output of said Buck converter circuit.

12. The circuit as set forth in claim 8 further comprising a fuse and crowbar circuit coupled to said regulated DC output of said Buck converter circuit whereby said crowbar circuit causes said line fuse to blow in response to an overvoltage condition.

13. The circuit as set forth in claim 8 further comprising a current feedback loop coupled to said primary transformer and said current/voltage transformer responsive to a voltage above a predetermined level to remove power from said primary transformer.

14. The circuit as set forth in claim 13 further comprising a start up time delay circuit coupled to said current feedback loop for a predetermined period to allow initial ionization of said gas discharge lamp.

15. The circuit as set forth in claim 8 wherein said unregulated output is filtered.

16. The circuit as set forth in claim 8 wherein said unregulated output contains up to 100 percent ripple.

17. The circuit as set forth in claim 8 wherein said output voltage of said primary transformer is relatively high.

18. The circuit as set forth in claim 8 wherein said output of said current/voltage transformer is coupled to a gas discharge lamp.

19. The circuit as set forth in claim 8 wherein said output of said current/voltage transformer is coupled to an electronic device.

* * * * *